US010870934B2

(12) United States Patent
Boff

(10) Patent No.: US 10,870,934 B2
(45) Date of Patent: Dec. 22, 2020

(54) METHOD FOR CLEANING A MACHINE FOR BRAIDING ELECTRICAL CABLES

(71) Applicant: SAFRAN ELECTRICAL & POWER, Blagnac (FR)

(72) Inventor: Anaêl Boff, Blagnac (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 244 days.

(21) Appl. No.: 15/742,859

(22) PCT Filed: Jul. 13, 2016

(86) PCT No.: PCT/FR2016/051817
§ 371 (c)(1),
(2) Date: Jan. 8, 2018

(87) PCT Pub. No.: WO2017/013336
PCT Pub. Date: Jan. 26, 2017

(65) Prior Publication Data

US 2018/0202086 A1 Jul. 19, 2018

(30) Foreign Application Priority Data

Jul. 23, 2015 (FR) ..... 15 57003

(51) Int. Cl.
*D04C 3/48* (2006.01)
*D04C 3/40* (2006.01)
(Continued)

(52) U.S. Cl.
CPC ..... *D04C 3/48* (2013.01); *B08B 1/006* (2013.01); *B08B 1/04* (2013.01); *B08B 13/00* (2013.01);
(Continued)

(58) Field of Classification Search
CPC combination set(s) only.
See application file for complete search history.

(56) References Cited

U.S. PATENT DOCUMENTS

| | | | |
|---|---|---|---|
| 1,796,938 | A | 3/1931 | Petersen |
| 1,978,086 | A | 10/1934 | Janssen |
| 2,237,858 | A | 4/1941 | Wright |

FOREIGN PATENT DOCUMENTS

| | | | |
|---|---|---|---|
| FR | 2 742 772 | A1 | 6/1997 |
| GB | 184832 | A | 8/1922 |

OTHER PUBLICATIONS

International Search Report dated Oct. 13, 2016, issued in corresponding International Application No. PCT/FR2016/051817, filed Jul. 13, 2016, 3 pages.

*Primary Examiner* — Erin F Bergner
(74) *Attorney, Agent, or Firm* — Christensen O'Connor Johnson Kindness PLLC

(57) ABSTRACT

Method for cleaning a braiding machine, particularly a machine for braiding electrical cables, said braiding machine comprising a plateau (12) for supporting an annular row of spindle drive members (14), characterized in that it comprises a step of equipping the machine with at least one cleaning tool (84), this cleaning tool comprising on the one hand means (90) configured to be driven by the members and, on the other hand, at least one guide element configured to be housed in slideways (32) for the movement of the tool, said guide element being configured to drive or to be equipped with a means (80) of cleaning said slideways, and a step of rotating said members so as to drive said cleaning means in said slideways.

10 Claims, 5 Drawing Sheets

(51) Int. Cl.

| | |
|---|---|
| ***B08B 1/00*** | (2006.01) |
| ***B08B 1/04*** | (2006.01) |
| ***B08B 13/00*** | (2006.01) |
| *H01B 13/26* | (2006.01) |

(52) U.S. Cl.
CPC ..... *D04C 3/40* (2013.01); *D10B 2401/16* (2013.01); *H01B 13/2606* (2013.01)

METHOD FOR CLEANING A MACHINE FOR BRAIDING ELECTRICAL CABLES

TECHNICAL FIELD

Embodiments of the present disclosure relate to a method for cleaning a braiding or overbraiding machine, in particular for electrical cables. The braid or overbraid forms a shield for the cable, for example.

BACKGROUND

A braiding machine, as shown in FIGS. 1 and 2 and provided with reference numeral 10, comprises a platform 12 for supporting an annular row of members 14 for driving bobbins 16. The members 14 extend around a first common axis A and are rotatably movable about second axes B which are substantially parallel to one another and to the first axis A.

The members 14, which can be seen more clearly in FIG. 3, each comprise a pinion 18, which is meshed with pinions 18 of adjacent members and a wheel 20, which comprises notches 22 over its circumference that are designed to receive complementary means 24 of the bobbins 16 so as to drive the bobbins about the second axes B.

As can be seen in FIGS. 6 and 7, each bobbin 16 has a lower base 26 and an upper coil of wire 28. In this case, the base 26 comprises two parallel plates 30, namely an upper plate and a lower plate. The plates 30 are mutually spaced and interconnected by rods which form the complementary means 24. The wheel 20 is intended to fit between the plates 30, the notches 22 in the wheel receiving the rods so as to rotate them (FIG. 3).

The platform 12 comprises means for guiding the bobbins 16, which means comprise, for each member 14, a sliding track or annular sliding groove 32 which extends around the second axis B of the corresponding member and is designed to receive at least one element 34 for guiding each bobbin so as to guide the bobbin about the second axis B. Each sliding track 32 is connected to adjacent sliding tracks 32 by switching means 36 (FIGS. 4 and 5) so as to rotate the bobbins 16 about the first axis A by moving the bobbins from one member to the next adjacent member in each case.

The sliding tracks 32 have to be cleaned regularly so as to remove residual grease and any pieces of wire. In the prior art, this maintenance task is carried out manually, as shown in FIG. 8. The width of the sliding tracks is relatively narrow and the tracks are currently cleaned by means of a cotton cloth which is moved along the sliding tracks by means of a laboratory spatula, for example. This maintenance operation is time-consuming and cumbersome. In this process, the user handling the spatula is also at high risk of getting injured when moving the cotton cloth along the sliding tracks.

SUMMARY

The present disclosure provides a simple, effective and economical solution to the above-mentioned problem.

For this purpose, the present disclosure proposes a method for cleaning a braiding machine, in particular for electrical cables, the braiding machine comprising a platform for supporting an annular row of members for driving bobbins, the members extending around a first common axis and being rotatably movable about second axes which are substantially parallel to one another and to the first axis, the members each comprising a pinion, which is meshed with pinions of adjacent members and a wheel which comprises notches over its circumference that are configured to receive complementary means of the bobbins so as to drive the bobbins about the second axes, the platform comprising means for guiding the bobbins, which means comprise, for each member, an annular sliding track which extends around the second axis of the corresponding member and is configured to receive at least one element for guiding each bobbin so as to guide the bobbin about the second axis, each sliding track being connected to adjacent sliding tracks by switching means so as to rotate the bobbins about the first axis by moving the bobbins from one member to the next adjacent member in each case, the method comprising:

- a step of providing the machine with at least one cleaning tool, the cleaning tool comprising means configured to be received in at least some of the notches in each wheel so as to drive the tool about the second axes, and at least one guide element configured to be received in the sliding tracks so as to move the tool about the first axis, the at least one guide element being configured to drive a means for cleaning the sliding tracks or to be provided with the means, and
- a step of rotating the members in order to drive the tool about the first and second axes.

The disclosure therefore proposes using a cleaning tool that is similar to a bobbin such that the machine cooperates with the tool and drives it about the axes as though it were a bobbin. The tool is provided with a guide element which engages with the sliding tracks, as is the case for a bobbin, but is capable of cleaning the tracks by means of a cleaning means. The element preferably has a specific shape which facilitates the driving of the cleaning means and minimizes the risk of the means getting stuck in the sliding tracks.

The method according to the disclosure may have one or more of the following steps:

- the cleaning means is a cloth, made of cotton for example;
- the method comprises:
  - a first provision step in which the cleaning tool is mounted on a first of the wheels,
  - a first step of rotating the members in order to drive the tool about the first and second axes,
  - a second provision step in which the cleaning tool is mounted on a wheel that is adjacent to the first wheel,
  - a second step of rotating the members in order to drive the tool about the first and second axes;
- the tool comprises two guide elements, namely a front guide element and a rear guide element, the front guide element being configured to drive the cleaning means or to be provided therewith;
- the tool comprises a base on which the guide elements are mounted such that they are free to rotate about substantially parallel axes;
- the front guide element comprises a truncation for accommodating and driving the cleaning means;
- the truncation defines a surface that is substantially perpendicular to a plane that passes through the axis of rotation of the corresponding element;
- each of the guide elements is generally in the shape of an ogive.

The present disclosure further relates to a cleaning tool for carrying out the method as described above, wherein it comprises a base comprising means configured to be received in at least some of the notches in each wheel so as to drive the tool about the second axes, the base having at least one guide element configured to be received in the sliding tracks so as to move the tool about the first axis, the at least one guide element being configured to drive a means for cleaning the sliding tracks or to be provided with the means.

The present disclosure further relates to a braiding machine, wherein it is provided with at least one cleaning tool as described above.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
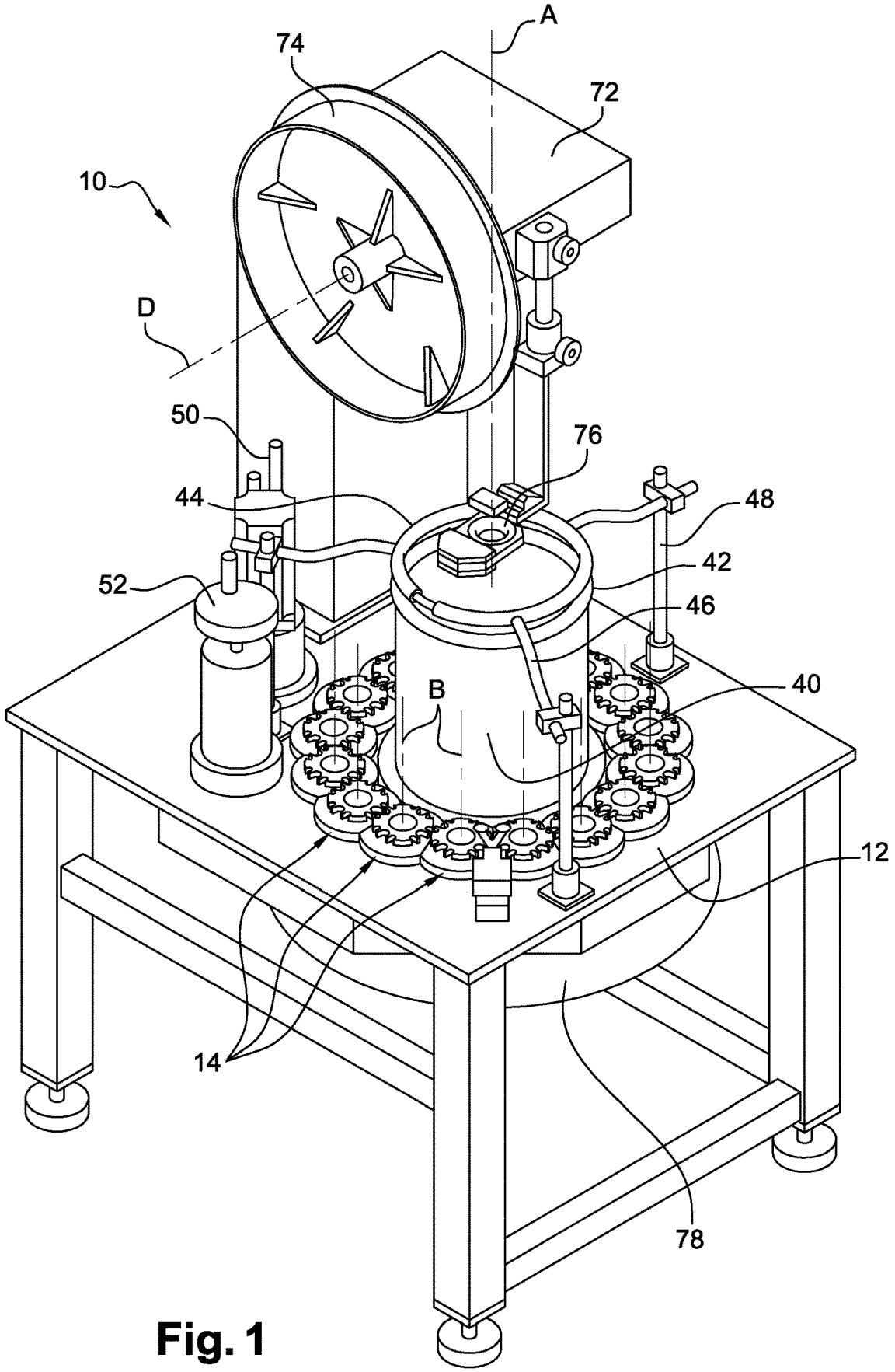
FIG. 1 is a schematic perspective view of a braiding machine, in particular for electrical cables.

Although the braiding machine 10 from FIG. 1 has already been described above, it will be described in more detail below.

The machine 10 comprises a table of which the upper platform forms the above-mentioned platform 12. The platform 12 is substantially horizontal in the example shown. It has a central chamber 40 which has a vertical axis A and around which the row of members 14 extends. The chamber 40 extends upwards from the platform 12 and has, on its upper end, a first ring 42 which has a rotational axis A.

A second ring 44 having the rotational axis A is arranged above the first ring 42 and at a distance therefrom so as to allow wires to pass between the rings 42, 44. The second ring 44 is connected to the upper ends of vertical rods 48 by means of substantially horizontal bars 46, the lower ends of which rods are attached to the platform 12. The rods 48, in this case three rods, are uniformly distributed around the axis A.

The wheel 22 of each member 14 is located on top of the platform 12 and the pinion 18 thereof is located under the platform 12. The pinions 18 of the members 14 are meshed with one another and with an output pinion of a motor 50, which is connected to a reduction gear 52 in this case. The motor 50 rotates a first member 14 in the clockwise direction (or anticlockwise direction), and this will cause the adjacent members to be driven in the opposite direction. Therefore, as shown schematically by the arrows in FIG. 4, half of the members 14 rotate in the clockwise direction and the other half of the members rotate in the anticlockwise direction.

The means for guiding the bobbins 16 have an annular row of sectors 54 which are attached to the platform 12 and each define the sliding track 32 of the corresponding member 14. Each sector 54 is formed, in this case, by a metal block in which the track 32 is made by means of machining. The sectors 54 are circumferentially arranged one next to the other around the axis A such that their ends meet, and the sectors comprise, at the circumferential ends thereof, housings 56 for receiving switching means 36.

Figure 4:
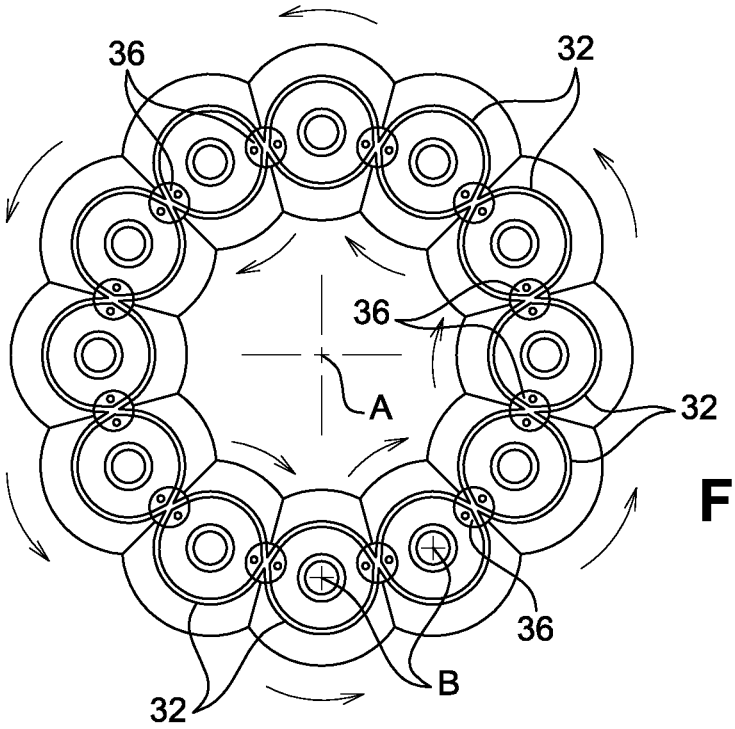
Figure 5:
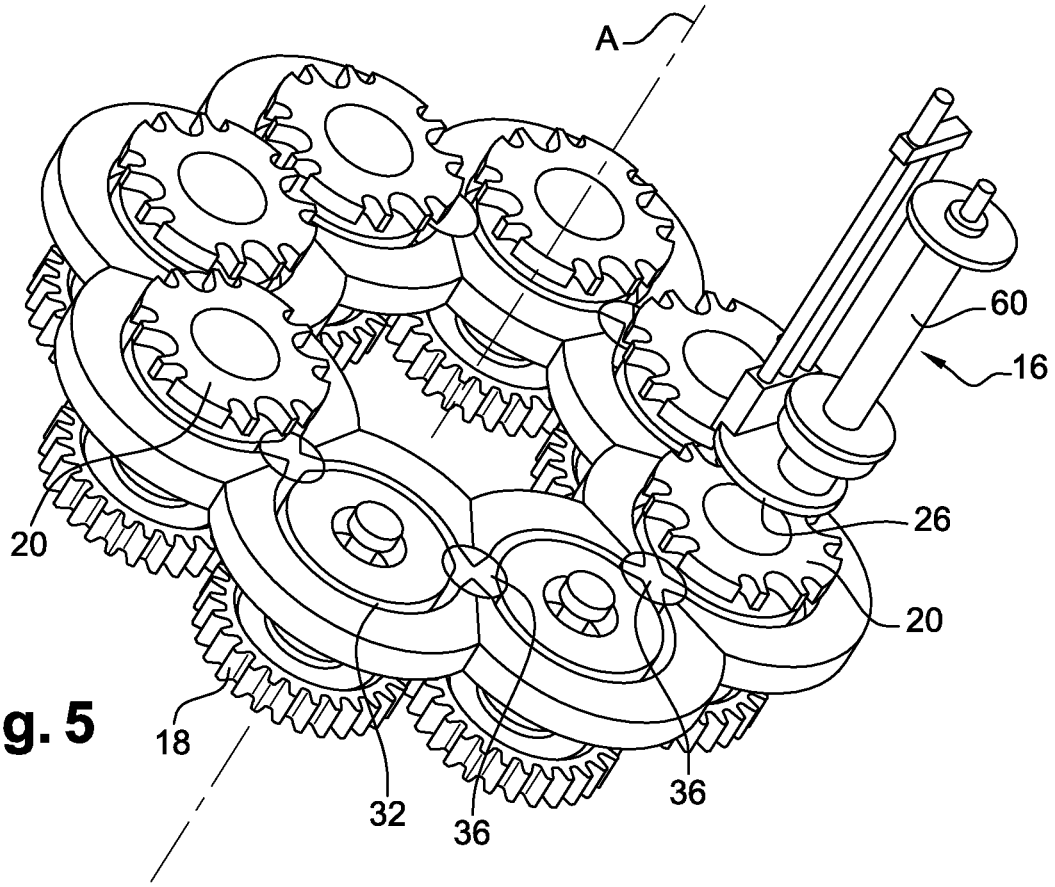

In the example shown in FIGS. 4 and 5, the switching means are discs 36. At each circumferential end of a sector 54, the housing 56 forms a break in the sliding track. The switching disc 36 has two track portions which intersect one another to form an X and connect the circumferential ends of the track of one sector to the circumferential ends of the track of the adjacent sector (FIGS. 4 and 5).

Figure 2:
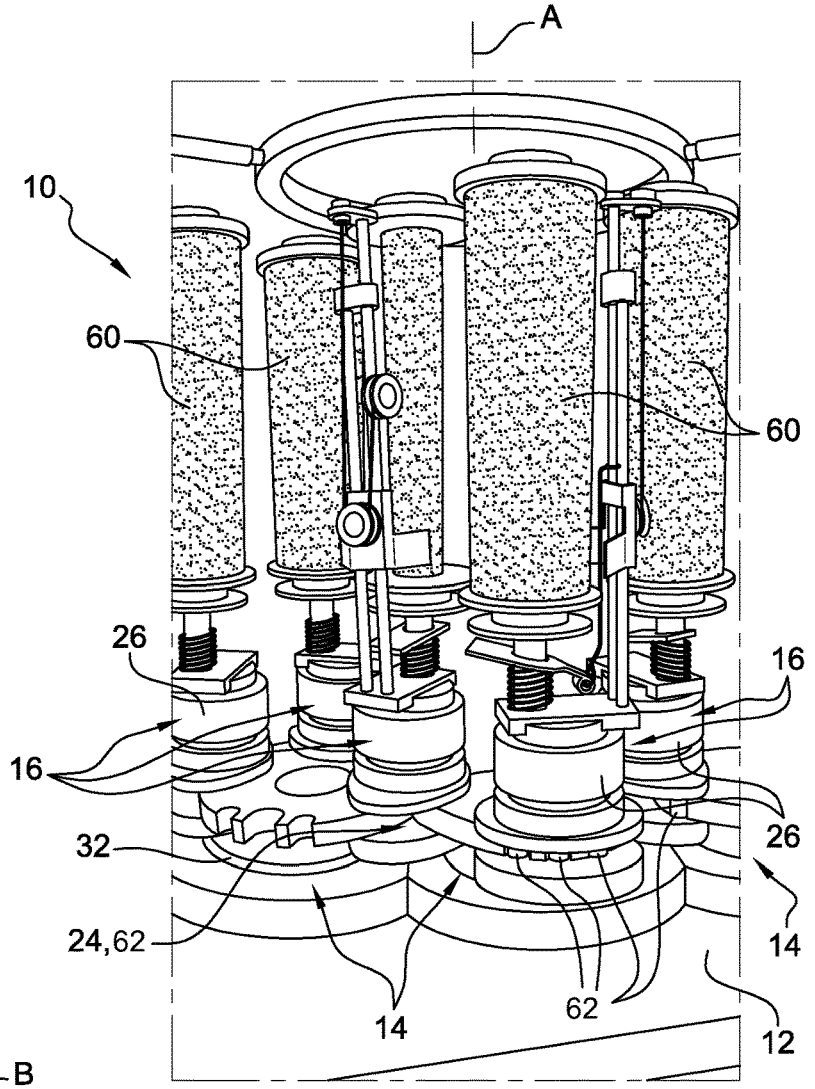
FIG. 2 is a schematic partial perspective view of part of the machine from FIG. 1 that has bobbins.
Figure 3:
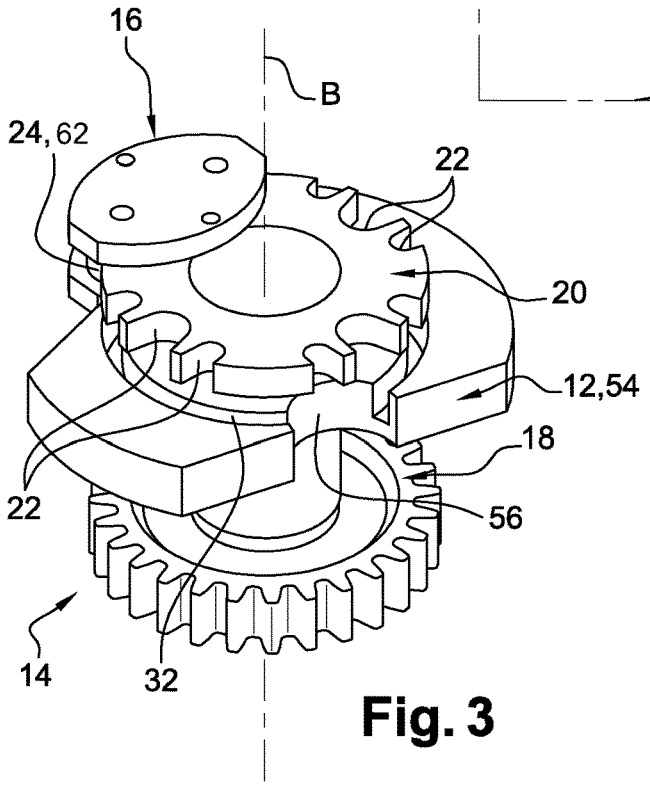
FIG. 3 is a schematic perspective view of a member for driving a bobbin of the machine from FIG. 1, FIGS. 4 and 5 are schematic views of an annular row of members for driving bobbins of the machine from FIG. 1, FIGS. 6 and 7 are schematic views of a base of a bobbin.
Figure 6:
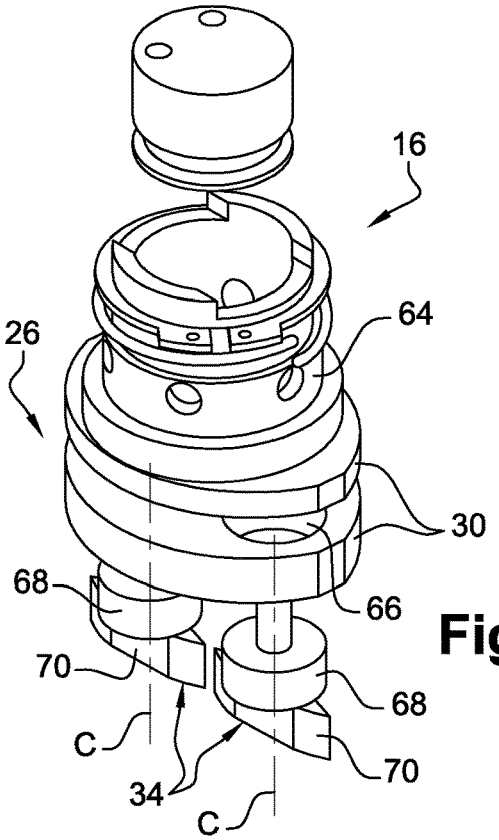
Figure 7:
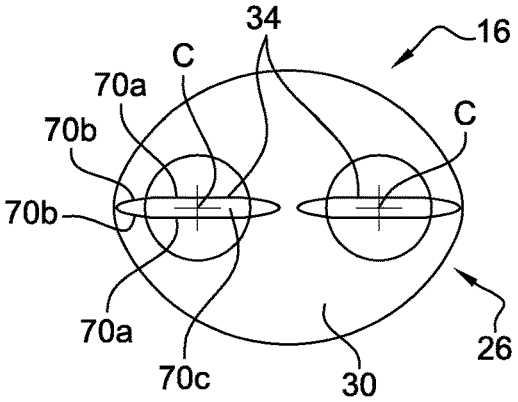

Each bobbin 16 has a lower base 26 and an upper coil of wire 60. FIGS. 6 and 7 show a base 26 which has in particular two plates 30 placed one on top of the other, namely a lower plate and an upper plate. The plates 30 have an elliptical or oblong peripheral contour. The plates are mutually spaced and interconnected by substantially vertical rods 62, which can be seen in FIG. 2. The space between the plates is configured to receive a circumferential portion of the wheel 20 of a member 14, the rods 62 being intended to fit in the notches 22 in the wheel 20. The rods 62 engaging with the notches 22 and the members 14 being rotated will result in the bobbins 16 being rotated.

The upper plate 30 has means 64 for attaching the coil 60. The lower plate 30 has cylindrical housings 66 for receiving the guide elements 34 and rotatably guiding the elements about vertical axes C that are parallel to one another. Each guide element 34 has an upper cylindrical member 68 which fits in the corresponding housing 66 with small clearances, and a lower ogive 70 intended to fit in the sliding tracks 32 and the switching discs 36 and engage therewith so as to rotatably guide the bobbins 16 about the axes A and B.

Each ogive 70 has an elongate shape and has a central body comprising two lateral surfaces 70*a* that are parallel to one another, and a front end and a rear end which taper to a point. Each of these ends has two inclined lateral surfaces 70*b*. Finally, each ogive 70 has a lower surface 70*c* which is substantially perpendicular to the axis C.

The machine 10 also comprises means for driving or winding up a cable so as to provide a braid or overbraid therearound. The means are supported by the platform 12 and have a vertical arm 72 (FIG. 1) which has a wheel 74 for driving a cable (not shown) about a horizontal axis D, which cable is intended to pass through the inside of the chamber 40 and through a guide band 76 arranged above the two rings 42, 44. A reel of cable that has not yet been provided with a braid can be located below the platform 12 in storage means 78.

The braiding machine 10 operates in the following manner. The cable which is to be surrounded by a braid is moved through the chamber 40 and the band 76, from the bottom towards the top, by being driven by the wheel 74. The bobbins 16 are mounted on the wheels 20, the rods 70 of the bases 26 of the bobbins 16 fitting in the notches 22 in the wheels 20 of the members 14. The wires on the bobbins 16 pass between the rings 42, 44 and are intertwined on the cable as it is moved upwards. For this purpose, each bobbin 16 is rotated about the axis B by means of a member 14, by engaging with the corresponding sliding track 32, and is then moved to a further member so as to rotate about the axis B of the further member, by engaging with the track portion of the disc 36 located between the members and by means of the sliding track of the further member. Some of the bobbins 16 rotate in the clockwise direction about the axis A and the remainder of the bobbins rotate in the anticlockwise direction about the axis A.

Figure 8:
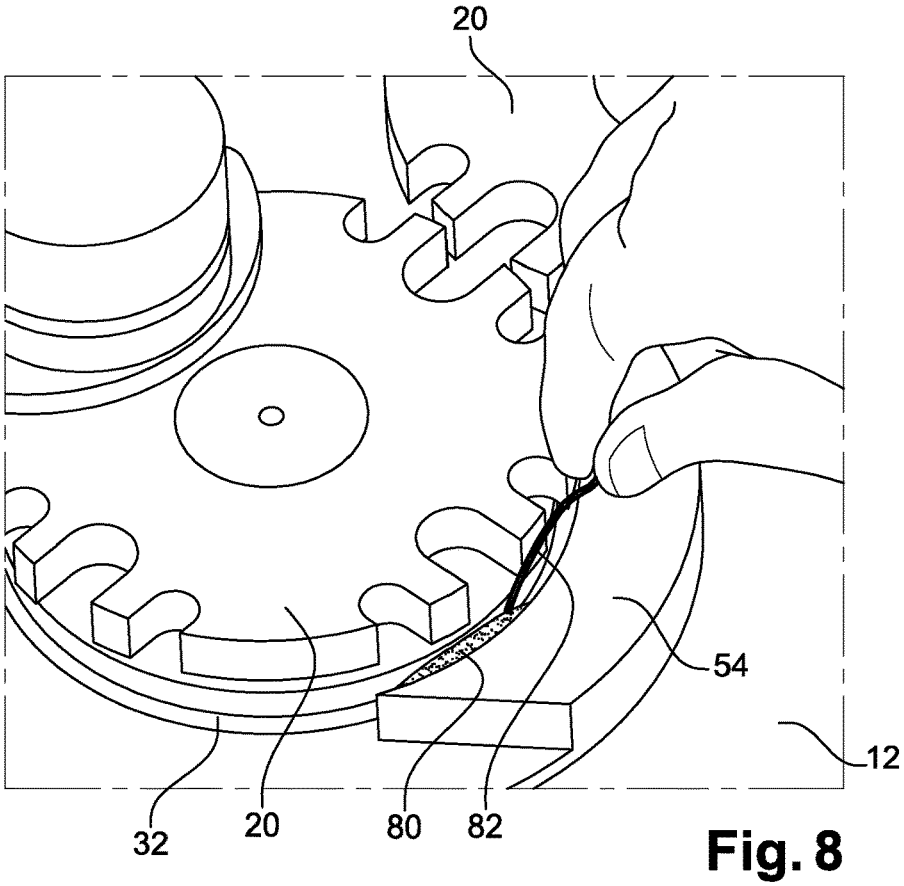
FIG. 8 is a schematic perspective view of part of the braiding machine, showing a step of cleaning a sliding track according to the prior art.

As explained above, the process for cleaning the sliding tracks 32 is time-consuming and cumbersome because it is carried out manually using a cotton cloth 80 and a metal spatula 82 used to move the cloth 80 along the track of each sector and from one track to the next (FIG. 8).

The present disclosure provides a simple, effective and economical solution to this problem, by means of a cleaning tool 84.

Figure 9:
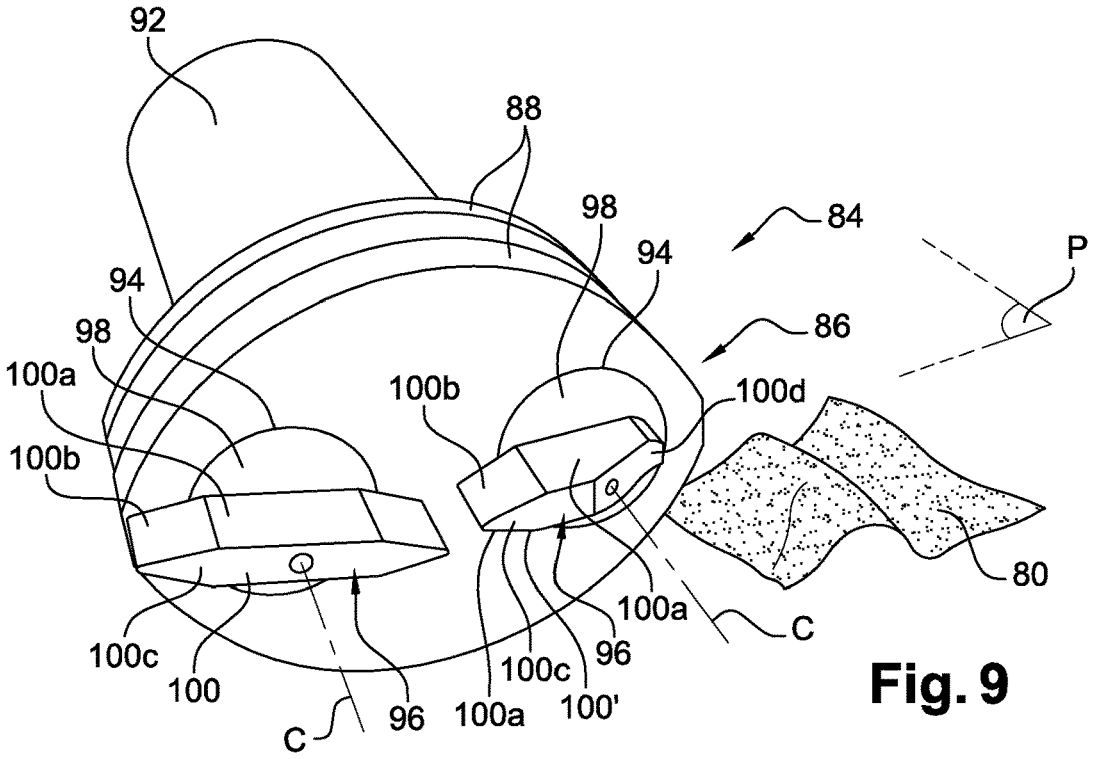
FIG. 9 is a schematic perspective view of a cleaning tool according to the disclosure.
Figure 10:
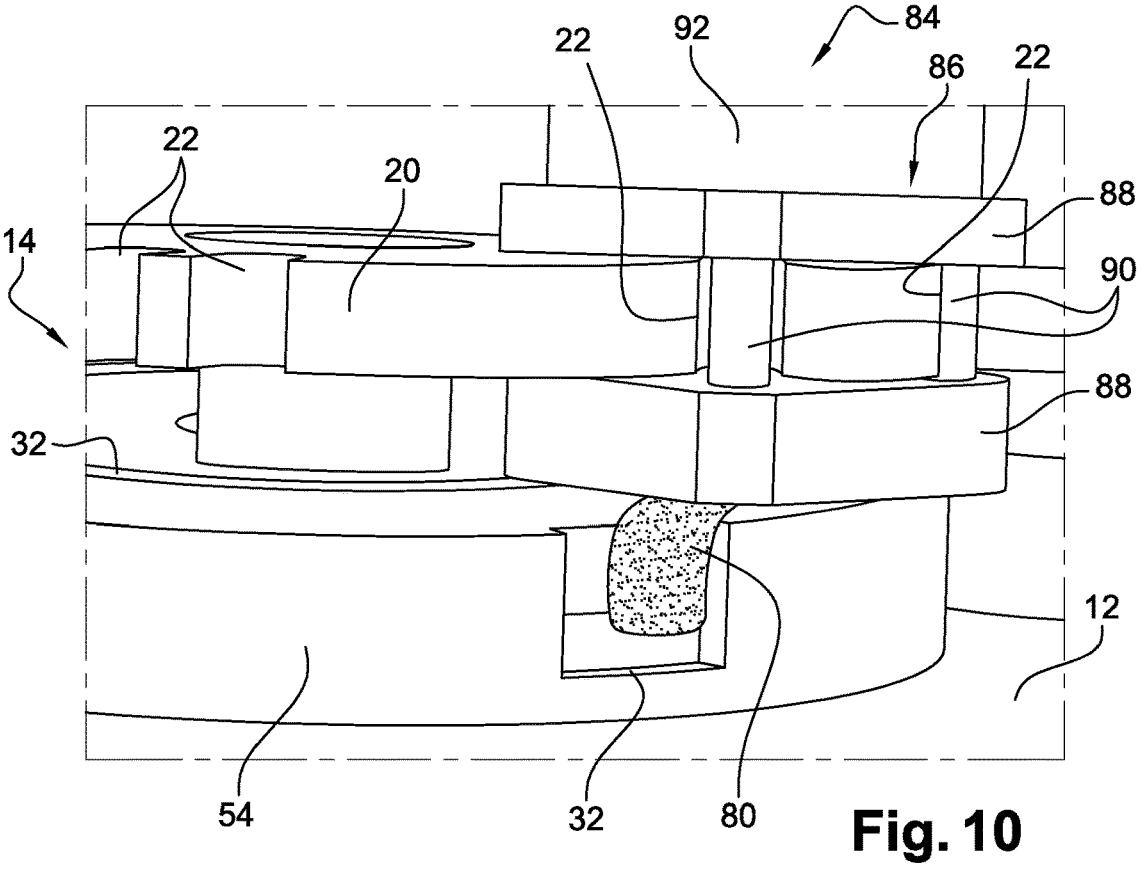
FIG. 10 is a schematic perspective view of part of the braiding machine, showing a step of cleaning a sliding track according to the disclosure.

FIGS. 9 and 10 show an embodiment of the cleaning tool 84 according to the disclosure. The tool 84 has a base 86 that is similar to the base 26 of a bobbin 16, such that the tool can engage with the members and be driven thereby, as explained above.

The base 86 has two plates 88 placed one on top of the other, namely a lower plate and an upper plate. The plates 88 have an elliptical or oblong peripheral contour. The plates are mutually spaced and interconnected by substantially vertical rods 90. The space between the plates is configured to receive a circumferential portion of the wheel 20 of a member 14, the rods 90 being intended to fit in the notches 22 in the wheel 20. The rods 90 engaging with the notches 22 and the members 14 being rotated will result in the tool 84 being rotated.

The upper plate 88 may have means 92 for gripping the tool. As is the case for the base 26, the lower plate 88 has cylindrical housings 94 for receiving the guide elements 96 and rotatably guiding the elements about vertical axes C that are parallel to one another. Each guide element 96 has an upper cylindrical member 98 which fits in the corresponding housing 96 with small clearances, and a lower ogive 100, 100' intended to fit in the sliding tracks 32 and the switching discs 36 and engage therewith so as to rotatably guide the bobbins 16 about the axes A and B.

The rear ogive 100 has an elongate shape and has a central body comprising two lateral surfaces 100*a* that are parallel to one another, and a front end and a rear end which taper to a point. Each of these ends has two inclined lateral surfaces 100*b*. Finally, the ogive 100 has a lower surface 100*c* which is substantially perpendicular to the axis C.

The front ogive 100' has an elongate shape and has a central body comprising two lateral surfaces 100*a* that are parallel to one another, and a rear end which tapers to a point and has two inclined lateral surfaces 100*b*. The ogive 100' also has a lower surface 100*c* which is substantially perpendicular to the axis C.

The ogive 100' is configured to drive a means for cleaning the sliding tracks 32, for example a piece of cotton or a cotton cloth, or to be provided with the means. In the example shown, the front end of the front ogive 100' has a truncation which defines a surface 100*d* that is inclined relative to the surface 100*c* and is substantially perpendicular to a longitudinal plane P of the ogive 100' that passes through the axis C thereof.

Furthermore, the front ogive 100' has a reduced length and is therefore shorter than the ogive 100, the front end of the front ogive having a front edge which is rounded, substantially around the axis C.

The surface 100*d* is a surface for bearing and driving the piece of cotton 80, which is therefore intended for being moved along the sliding tracks 32 so as to clean the tracks as the tool is moved along by means of the members 14.

The sliding tracks 32 of the braiding machine 10 can be cleaned in the following manner. At least one tool 84 is mounted on a member 14, the rods 90 of the base 86 of the tool fitting in the notches 22 in the wheel 20 of the member 14. The ogives 100, 100' of the base fit in the corresponding sliding track 32 and a piece of cotton 80 is arranged in front of the front ogive and wedged between the bottom of the sliding track and the surface 100*d* of the ogive 100'. The tool 84 is rotated about the axis B by means of the member 14, by engaging with the corresponding sliding track 32, and is then moved to a further member so as to rotate about the axis B of the further member, by engaging with the track portion of the disc 36 located between the members and by means of the sliding track of the further member. The tool 84 rotates in the clockwise direction (or the anticlockwise direction) about the axis A, and this makes it possible to clean half of the sliding tracks 32. The tool is withdrawn from the member and mounted on a member that is directly adjacent thereto, and the above-mentioned steps are repeated such that the tool 84 rotates in the anticlockwise direction (or clockwise direction) about the axis A, and this makes it possible to clean the other half of the sliding tracks 32.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A method for cleaning a braiding machine having a platform for supporting an annular row of members for driving bobbins, said members extending around a first common axis and being rotatably movable about a plurality of second axes which are substantially parallel to one another and to said first common axis, said members each comprising a pinion meshed with pinions of adjacent members and a wheel which comprises notches over its circumference configured to receive complementary portions of the bobbins so as to drive said bobbins about said plurality of second axes, said platform comprising, for each member, an annular sliding track which extends around one of the plurality of second axes of the corresponding member and is configured to receive an element for guiding each bobbin so as to guide said bobbin about said one of the plurality of second axes, each sliding track being connected to adjacent sliding tracks by a switch so as to rotate the bobbins about said first common axis by moving the bobbins from one member to the next adjacent member in each instance, said method comprising:

providing a cleaning tool with the machine, said cleaning tool including first portions to be received in at least some of the notches in each wheel so as to drive said cleaning tool about said plurality of second axes, said cleaning tool comprising one or more bearing surfaces of a first guide to be received in said sliding tracks so as to move said cleaning tool about said first common axis, at least one bearing surface of said one or more bearing surfaces of the first guide being configured to drive a piece of cotton or cleaning cloth to clean said sliding tracks or to be provided with said piece of cotton or cleaning cloth; and rotating said members to drive said cleaning tool about said first common axis and said plurality of second axes.

2. The method of claim 1, wherein said first portions of said cleaning tool include rods.

3. The method of claim 1, further comprising:

mounting the cleaning tool on a first of said wheels, rotating said members in order to drive said cleaning tool about said first common axis and said plurality of second axes, thereafter mounting the cleaning tool on a second wheel that is adjacent to said first wheel, rotating said members in order to drive said cleaning tool about said first common axis and said plurality of second axes.

4. The method of claim 1, wherein said cleaning tool comprises a second guide having one or more bearing surfaces.

5. The method of claim 4, wherein said cleaning tool said first and second guides are mounted such that the first and second guides are free to rotate about substantially parallel axes.

6. The method of claim 4, wherein said first guide comprises a truncation for accommodating and driving said piece of cotton or cleaning cloth.

7. The method of claim 6, wherein said truncation is defined by said at least one bearing surface that is substantially perpendicular to a plane that passes through the axis of rotation of the first guide.

8. The method of claim 4, wherein each of said first and second guides is generally in the shape of an ogive.

9. A cleaning tool, comprising:

a tool body having a base with base portions receivable in at least some of a plurality of notches in a wheel so as to drive said cleaning tool about a plurality of axes, said base having a guide with one or more bearing surfaces to be received in sliding tracks so as to move said cleaning tool about a first common axis, said one or more bearing surfaces of the guide being configured to drive a piece of cotton or cleaning cloth to clean said sliding tracks or to be provided with said piece of cotton or cleaning cloth.

10. A braiding machine provided with a cleaning tool according to claim 9.

* * * * *